United States Patent [19]

Tsubota et al.

[11] 4,178,182

[45] Dec. 11, 1979

[54] COLOR DIFFUSION-TRANSFER PHOTOGRAPHIC ELEMENT

[75] Inventors: Motohiko Tsubota; Shinji Sakaguchi; Nobuo Tsuji, all of Minami-ashigara, Japan

[73] Assignees: Fuji Photo Film Co., Ltd, Kanagawa, Japan; National Patent Development Corporation, New York, N.Y.

[21] Appl. No.: 500,016

[22] Filed: Aug. 23, 1974

[30] Foreign Application Priority Data

Aug. 24, 1973 [JP] Japan ..... 48-94330

[51] Int. Cl.[2] ..... G03C 1/40; G03C 1/76; G03C 7/00; G03C 5/54

[52] U.S. Cl. ..... 96/73; 96/3; 96/29 D; 96/74; 96/77

[58] Field of Search ..... 96/3, 29 D, 77, 68, 96/69, 73, 74

[56] References Cited

U.S. PATENT DOCUMENTS

| | | | |
|---|---|---|---|
| 3,427,158 | 2/1969 | Carlson et al. | 96/3 |
| 3,615,422 | 10/1971 | Haberlin | 96/3 |
| 3,840,371 | 10/1974 | Usami et al. | 96/94 R |
| 3,847,615 | 11/1974 | Yoshida et al. | 96/3 |

*Primary Examiner*—Richard L. Schilling
*Attorney, Agent, or Firm*—Cushman, Darby & Cushman

[57] ABSTRACT

In a color diffusion-transfer photographic element comprising a support carrying at least two color image forming units, each comprising a selectively sensitized silver halide emulsion layer and a color image-forming material contained in either said silver halide emulsion layer or a layer adjacent to said silver halide emulsion layer, there is provided an intermediate layer between two of said color image-forming units or protective overcoating layer comprising a polymer of at least one monoacrylate or monomethacrylate of an aliphatic polyhydric alcohol.

37 Claims, 1 Drawing Figure

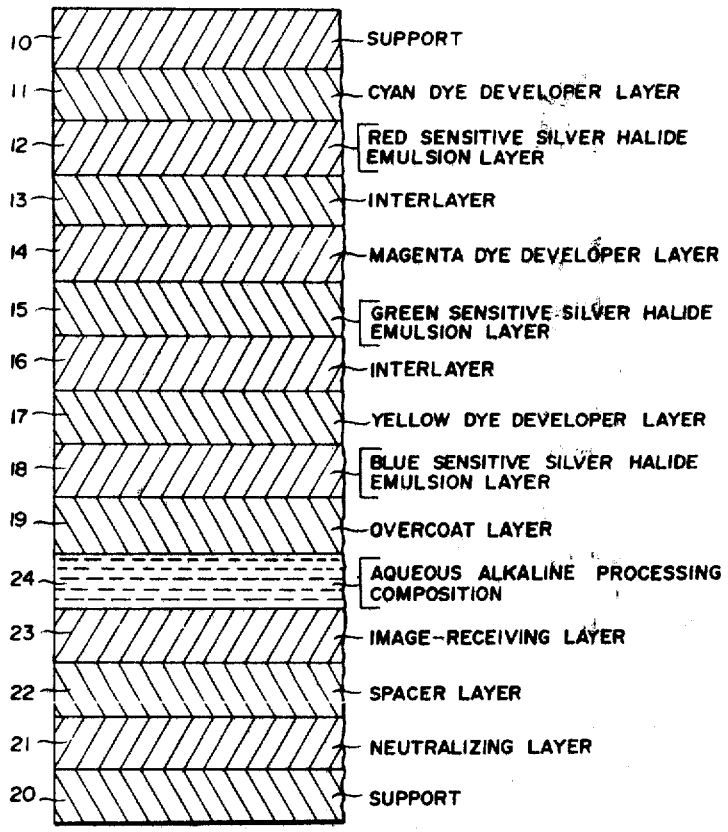

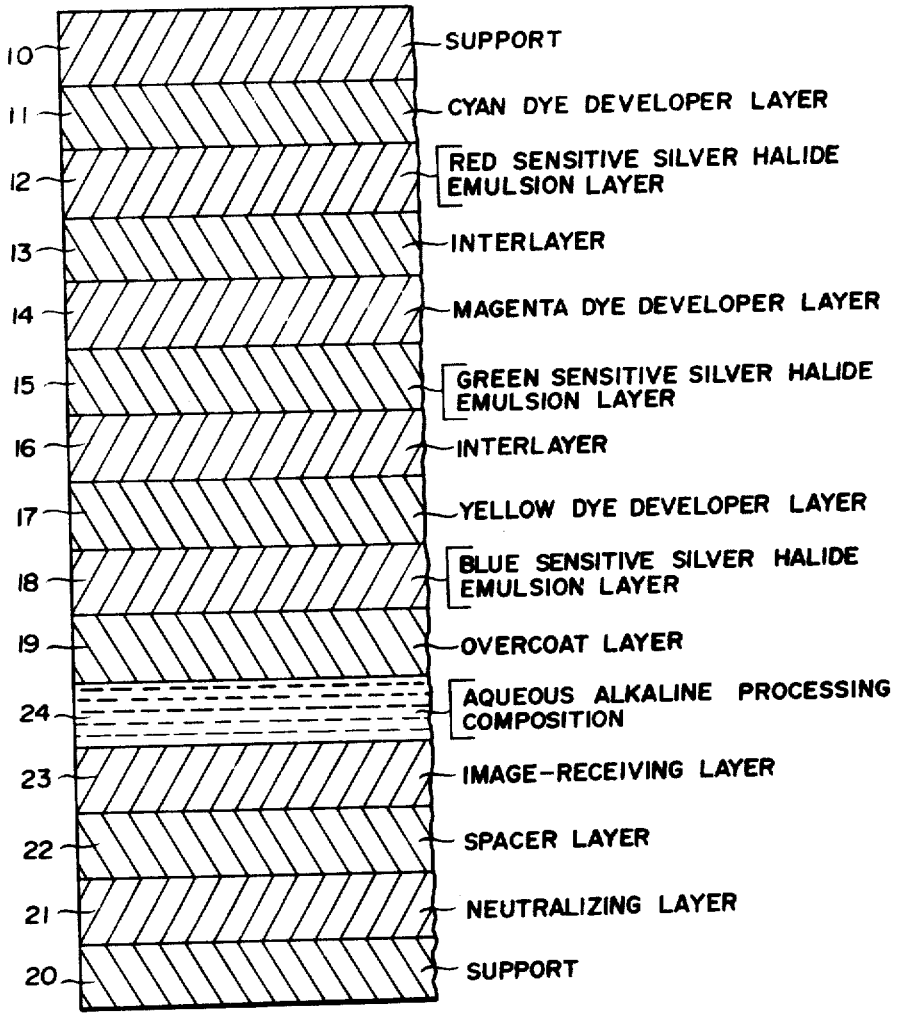
10
SUPPORT
11
CYAN DYE DEVELOPER LAYER
12
RED SENSITIVE SILVER HALIDE EMULSION LAYER
13
INTERLAYER
14
MAGENTA DYE DEVELOPER LAYER
15
GREEN SENSITIVE SILVER HALIDE EMULSION LAYER
16
INTERLAYER
17
YELLOW DYE DEVELOPER LAYER
18
BLUE SENSITIVE SILVER HALIDE EMULSION LAYER
19
OVERCOAT LAYER
24
AQUEOUS ALKALINE PROCESSING COMPOSITION
23
IMAGE-RECEIVING LAYER
22
SPACER LAYER
21
NEUTRALIZING LAYER
20
SUPPORT

COLOR DIFFUSION-TRANSFER PHOTOGRAPHIC ELEMENT

This invention relates to a color diffusion-transfer photographic element and, more particularly, to a photographic product used in a color diffusion-transfer process employing color image forming materials.

There have hitherto been known color diffusion-transfer photographic products comprising a support carrying thereon at least two color image-forming units, each comprising a selectively sensitized silver halide emulsion layer and a color image-forming material contained in either said silver halide emulsion layer or a layer adjacent to said silver halide emulsion layer, in which there have been used as interlayers between two of said at least two color image forming units or protective overcoating layers gelatin and certain polymers, as disclosed in British Pat. No. 1,003,676 and U.S. Pat. No. 3,625,685, for the purpose mainly of improved color separation and additionally of improvements in density and tint.

However, the prior products are unsatisfactory for production on commercial scale because of insufficient stability of the color image-forming materials, the integral components of the photosensitive element, in a photographic film, i.e., instabilization of color image-forming materials caused by interaction between silver halide emulsions and the color image-forming materials and because of poor mechanical strength of the photosensitive element-coated film, i.e., resistance to breakage of fine particles contained in a dispersion of a color image-forming material by a slight pressure.

An object of the present invention accordingly is to provide an improvement in the commercial production of color diffusion transfer photographic products.

Another object of the present invention is to provide a multi-layered photosensitive element having on at least one silver halide emulsion layer associated with a color image forming material a protective or barrier layer comprising a polymer or mixture of a polymer with gelatin for preventing deposition of crystals from a dispersion of a color image-forming material and adverse effect of exudation of a dispersion medium, such as an oil, on an adjacent layer.

Still another object of the present invention is to provide a method of processing, in a camera or a device separated from a camera, a photosensitive element comprising a processing composition suitable for forming a print formed of color image forming materials and an image receiving element.

A further object of the present invention is to provide a photosensitive element having good storage stability for use in diffusion-transfer color photography.

A still further object of the present invention is to provide a photosensitive element for diffusion-transfer color photography which is improved in various features without any adverse side-effect.

The present invention accordingly comprises a color diffusion-transfer photographic element comprising a support carrying thereon at least two color image-forming units each comprising a selectively sensitized silver halide emulsion layer associated with a color image-forming material contained in either said silver halide emulsion layer or in a protective overcoating layer adjacent to said silver halide emulsion layer, which further comprises a polymer of a monoacrylate or monomethacrylate of an aliphatic polyhydric alcohol as an interlayer between two of said at least two color image forming units or protective overcoating layer. The aliphatic polyhydric alcohols are usually alkanepolyols, e.g., alkanediols, alkanetetraols, alkanetriols or alkaneether alkane polyols, e.g., alkane ether alkane diols, or alkane (polyoxyalkane) polyols, e.g., triethylene glycol and tripropylene glycol.

Namely, there are obtained remarkable improvements and the aforesaid objects are attained by providing at least one layer of a polymer of a monocrylate or monomethacrylate of such an aliphatic polyhydric alcohol as an interlayer and/or protective overcoating layer in a diffusion-transfer color photographic element. It is surprising and not previously known that use of the polymer in accordance with the present invention remarkably minimizes the significant drawbacks in the prior diffusion-transfer color photographic products, such as, e.g., instability of dye developers in the element, i.e., deposition of crystals of dye developers, recombination of colloidal particles contained in dispersions of dye developers, haze attributable to the said deposition and recombination, poor adhesion between an emulsion layer and adjacent layers and exudation or migration of an oil employed for dispersing dye developers.

For a fuller understanding of the nature and objects of the present invention, reference should be had to the following greater detailed description, taken in conjunction with the accompanying drawing, in which the single FIGURE is an exaggerated cross-sectional view of an image receiving material representative of the present invention.

The aliphatic polyhydric alcohols forming the monoacrylates or monomethacrylates as an integral constituent of the polymer in accordance with the present invention are compounds having a carbon chain containing 2 to 8 carbon atoms and 2 to 4 hydroxyl groups in the molecule. Monoesters thereof with acrylic acid or methacrylic acid are employed as monomers or comonomers for the preparation of the polymer of the present invention. Representatives of the ester are, e.g., 2-hydroxyethyl methacrylate, 3-hydroxypropyl methacrylate, 2-hydroxypropyl methacrylate, 4-hydroxybutyl methacrylate, 5-hydroxypentyl methacrylate, 2,2-dimethyl-3-hydroxypropyl methacrylate, diethyleneglycol monomethacrylate, triethyleneglycol monomethacrylate, dipropyleneglycol monomethacrylate, glycerol monomethacrylate, trimethylolethane monomethacrylate, trimethylolpropane monomethacrylate, pentaerythritol monomethacrylate, 2-hydroxyethyl acrylate, 3-hydroxypropyl acrylate, 2-hydroxypropyl acrylate, 4-hydroxybutyl acrylate, 5-hydroxypropyl acrylate, 2,2-dimethyl-3-hydroxypropyl acrylate, diethyleneglycol monoacrylate, triethyleneglycol monoacrylate, dipropyleneglycol acrylate, glycerol monoacrylate, trimethylolethane monoacrylate trimethylolpropane monoacrylate, pentaerythritol monoacrylate, tetraethyleneglycol acrylate, 8-hydroxyoctyl methacrylate, and the like.

The term "polymer" as used in the present application, means homopolymers, copolymers, and polymer blends containing at least one of the aforesaid monoesters as a monomer component.

The copolymers include as a special species, graft copolymers.

The addition-polymerizable unsaturated compounds which can be copolymerized with the aforesaid monoesters include compounds containing a single additionpolymerizable unsaturated bond, e.g., an ethylenic double bond, such as organic acrylates, acrylamides, organic methacrylate, methacrylamides, allyl compounds, vinyl esters, vinyl ethers, organic crotonates, styrenes and the like. Examples are: organic acrylates, such as alkyl acrylates, e.g., methyl acrylate, ethyl acrylate, propyl acrylate, butyl acrylate, amyl acrylate, 2-ethylhexyl acrylate, octyl acrylate, tert.-octyl acrylate, and other acrylates, e.g., chloroethyl acrylate, 2,2-dimethylhydroxypropyl acrylate, 5-hydroxypentyl acrylate, trimethylolpropane monoacrylate, pentaery thritol monoacrylate, glycidyl acrylate, benzyl acrylate, methoxybenzyl acrylate, furfuryl acrylate, and tetrahydrofurfuryl acrylate, and aryl acrylates, e.g., phenyl acrylate; organic methacrylates, such as alkyl methacrylates, e.g., methyl methacrylate, ethyl methacrylate, propyl methacrylate, isopropyl methacrylate, butyl methacrylate, amyl methacrylate, hexyl methacrylate, cyclohexyl methacrylate, benzyl methacrylate, chlorobenzyl methacrylate, octyl methacrylate, and other methacrylates, e.g., 4-hydroxybutyl methacrylate, 5-hydroxypentyl methacrylate, 2,2-dimethyl-3-hydroxypropyl methacrylate, trimethylolpropane monomethacrylate, pentaerythritol monomethacrylate, glycidyl methacrylate, furfuryl methacrylate and tetrahydrofurfuryl methacrylate, and aryl methacrylates, e.g., phenyl methacrylate, cresyl methacrylate and naphthyl methacrylate; acrylamides, such as acrylamide itself, mono-N-alkylacrylamides wherein the alkyl is, e.g., methyl, ethyl, propyl, butyl, t-butyl, heptyl, octyl, cyclohexyl, benzyl or pentyl, e.g., N,N-dimethyl acrylamide, N,N-dibutyl acrylamide, N-hydroxyalkylacrylamides, e.g., hydroxyethylacrylamide, mono-N-arylacrylamides wherein the aryl is, e.g., phenyl tolyl or naphthyl, and N-hydroxyarylacrylamides, e.g., hydroxyphenylacrylamide. N,N-dialkylacrylamides wherein the alkyl is, e.g., methyl, ethyl, propyl, butyl isobutyl, 2-ethylhexyl or octyl, N,N-diarylacrylamides wherein the aryl is, e.g., phenyl, e.g., N,N-diphenyl arylamide and mixed N-alkyl-N-aryl acrylamides, e.g., N-methyl-N-phenylacrylamide, N-2-acetamidoethyl-N-acetylacrylamide and the like; methacrylamides, such as methacrylamide itself, mono-N-alkylmethacrylamides wherein the alkyl is, e.g., methyl, ethyl, t-butyl, 2-ethylhexyl, and cyclohexyl and N-hydroxy alkyl methacrylamides, e.g., hydroxyethyl, N-arylmethacrylamides wherein the aryl is, e.g., phenyl, N,N-dialkylmethacrylamides wherein the alkyl is, e.g., methyl, ethyl, propyl and/or butyl, e.g., dimethylmethacrylamide, dibutylmethacrylamide, N,N-diarylmethacrylamides wherein the aryl is, e.g., phenyl, N-hydroxyethyl-N-methylmethacrylamide, N-methyl-N-phenylmethacrylamide and N-ethyl-N-phenylmethacrylamide; allyl compounds, such as allyl esters, e.g., allyl acetate, allyl caproate, allyl caprylate, allyl acetoacetate, allyl laurate, allyl palmitate, allyl stearate, allyl benzoate and allyl lactate, and allyloxyethanol; vinyl ethers, such as alkyl vinyl ethers, e.g., hexyl vinyl ether, octyl vinyl ether, decyl vinyl ether, 2-ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl vinyl ether, hydroxyethyl vinyl ether, vinyl methyl ether, diethyleneglycol vinyl ether, dimethylaminoethyl vinyl ether, butylaminoethyl vinyl ether, diethylaminoethyl vinyl ether, benzyl vinyl ether and tetrahydrofurfuryl vinyl ether, and vinyl aryl ethers and vinyl haloaryl ethers, e.g., vinyl phenyl ether, vinyl tolyl ether, vinyl chlorophenyl ether, vinyl 2,4-dichlorophenyl ether, vinyl naphthyl ether and vinyl anthranyl ether; vinyl esters, e.g., vinyl acetate, vinyl butyrate, vinyl isobutyrate, vinyl trimethylacetate, vinyl diethylacetate, vinyl valerate, vinyl caproate, vinyl chloroacetate, vinyl dichloroacetate, vinyl methoxyacetate, vinyl butoxyacetate, vinyl phenyl acetate, vinyl acetoacetate, vinyl lactate, vinyl propionate, vinyl beta-phenyl-butyrate, vinyl cyclohexanecarboxylate, vinyl benzoate, vinyl salicylate, vinyl chlorobenzoate, vinyl tetrachlorobenzoate and vinyl naphthoate; styrenes, such as styrene itself, alkylstyrenes, e.g., p-methylstyrene, o-methylstyrene, 2,4-diemthylstyrene, trimethylstyrene, p-butylstyrene, p-hexylstyrene, alpha-methylstyrene, p-cyclohexylstyrene, decylstyrene, benzylstyrene, chloromethylstyrene, trifluoromethylstyrene, ethoxymethylstyrene and acetoxymethylstyrene, alkoxystyrenes, e.g., p-methoxystyrene, 4-methoxy-3-methylstyrene and dimethoxystyrene, and halogenostyrenes, e.g., p-chlorostyrene, tetrachlorostyrene, pentachlorostyrene, p-bromostyrene, 2,4-dibromostyrene, fluorostyrene, iodostyrene, trifluorostyrene, 2-bromo-4-trifluoromethylstyrene and 4-fluoro-3-trifluoromethylstyrene; organic crotonates, such as alkyl crotonates, e.g., butyl crotonate, hexyl crotonate and glycerol monocrotonate; dialkyl itaconates, e.g., dimethyl itaconate, diethyl itaconate and dibutyl itaconate; dialkyl maleates and fumarates, e.g., dimethyl maleate, diethyl maleate, diethyl fumarate and dibutyl fumarate; acrylonitrile; methacrylonitrile, and the like. In addition, there can be used any additionpolymerizable unsaturated compounds capable of copolymerizing with the compound represented by the aforesaid monoesters.

The preferred monomer ratio is such that the monoacrylate or monomethacrylate of an aliphatic polyhydric alcohol amounts to at least 50, more desirably at least 60 mole % of all monomers present and it can be 100%. The polymers include all the categories set forth in the following Table 1.

TABLE 1

| Categories | Recurring Units |
|---|---|
| 1. Homopolymer | $-A_1-$, alone |
| 2. Copolymer | |
| (1) Component A alone | |
| 1. 2 A's | $-A_1-A_2-$, $-A_1-$, $-A_2-$ |
| 2. 3 or more A's | $-A_1-A_2-A_3-\ldots$, $-A_1-$, $-A_2-$, $-A_3-$, ..., $-A_x-$ |
| (2) Including A & B | |
| 1. 1 A | |
| (i) 1B | $-A_1-B_1-$, $-A_1-$, $-B_1-$ |
| (ii) Many B's | $-A_1-B_1-B_2-\ldots-B_x-$, $-A_1-$, $-B_1-$, $-B_2-$, ..., $-B_x-$ |
| 2. Many A's | |
| (i) 1B | $-A_1-$, $-A_2-$, $-A_3-$, ..., $-A_x-$, $-B_1-$ |
| (ii) Many B's | $-A_1-$, $-A_2-$, ..., $-A_x-$, $-B_1-$, $-B_2-$, ..., $-B_x-$ |

where, in the above Table 1, A represents the aforesaid acrylate or methacrylate monoester; $A_1$, $A_2$, $A_3$, . . . and $A_x$ individually represents a monoester belonging to the A series; B represents the aforesaid comonomer; and $B_1$, $B_2$, $B_3$, . . . and $B_x$ individually represent a comonomer belonging to the B.

The polymer of the present invention includes all those shown in the above Table 1, and the copolymers include ordinary graft copolymers.

The polymers used in the present invention may be synthesized by a conventional solution, suspension or block polymerization process. The graft copolymers may be prepared by graft polymerizing one or more of the aforesaid monoacrylate or monomethacrylates of an aliphatic polyhydric alcohol in a solution of a polymer capable of graft-copolymerizable with the aforesaid acrylate or methacrylate or with gelatin, polyvinyl alcohol, carboxymethylcellulose, starch, hydroxyethylcellulose or like polymer.

It is preferred to employ, as the solvent for solution polymerization, an aprotic solvent such as hexamethylenephosphoramide, dimethylformamide, formamide, pyridine, dimethylsulfoxide, methanol, ethanol, tert.-butanol, diethylene glycol, 2-methoxyethanol, formic acid, acetic acid, dioxane and the like. The polymerization is carried out in general at temperatures of 20° to 150° C., preferably of 40° to 100° C. The polymerization is performed in general with 0.05 to 2% by weight of a radical catalyst, based on the total weight of polymerizable monomer or monomers. As representative catalysts, there are mentioned azobis compounds, peroxides, redox catalysts; for example, potassium persulfate, tert.-butyl peroctoate, benzoyl peroxide, isopropyl percarbonate, 2,4-dichlorobenzoyl peroxide, methyl ethyl ketone peroxide, cumene hydroperoxide, dicumyl peroxide, azobisisobutyronitrile and the like. Polymerization can also be accomplished by irradiation and other conventional procedures.

In the practice of the present invention, there is employed a polymer of a molecular weight usually of at least about 10,000, preferably of 50,000 to 700,000, though these values are not critical for obtaining the advantages of the present invention.

In all of the following examples, determination of molecular weight was made by gel permeation chromatography.

Synthesis of polymers for use in the practice of the present invention are illustrated in the following examples.

EXAMPLE 1

550 ml of water and 550 ml of ethanol were charged and mixed in a 2,000 ml flask, then there were added thereto 200 g of 2-hydroxyethyl methacrylate, 1 g of potassium persulfate and 1 g of sodium hydrogen sulfite. The flask was then purged of air with gaseous nitrogen and the charge was stirred at 60° C. for 4 hours to effect polymerization. The reaction mixture was then filtered and the filtrate was poured into about 10 times its volume of cold water to precipitate a solid. After removal of the greater part of the liquid phase by decantation, the residue was dried in vacuo to obtain 160 g of a polymer of an average molecular weight of about 350,000.

EXAMPLE 2

550 ml of water and 500 ml of ethanol were mixed in a 2,000 ml flask, then there were added threto 186 g of 2-hydroxyethyl methacrylate, 21.3 g of acrylamide, 0.8 g of potassium persulfate and 0.8 g of sodium hydrogen sulfite. The flask was then purged of air with gaseous nitrogen and the charge was stirred at 70° C. for 3 hours to effect polymerization. The reaction mixture was then dialyzed for 15 to 20 hours in running water and dried in a freeze-dryer to obtain 197 g of a polymer of an average molecular weight of 200,000.

EXAMPLE 3

The same procedure as in Example 2 was repeated except that there were used 117 g of 2-hydroxyethyl methacrylate and 99.4 g of 2-hydroxyethyl acrylate in place of 186 g of 2-hydroxyethyl methacrylate and 21.3 g of acrylamide, to obtain 192 g of a polymer of an average molecular weight of 100,000.

EXAMPLE 4

In a 2,000 ml three-necked flask there were charged 600 ml of ethanol, 500 ml of distilled water, 255 g of 2-hydroxyethyl methacrylate, 15 g of methacrylic acid and 30 g of N,N-dimethylaminoethyl methacrylate, and, after purging of air with gaseous nitrogen there were added threto an aqueous solution of 3.14 g of potassium persulfate in 100 ml of distilled water with heating to 70° C. The mixture was stirred at 70° C. for 6 hours to effect polymerization. The reaction mixture was then filtered, dialyzed through a regenerated cellulose film in running water for 20 to 24 hours and dried in a freezedryer to obtain 274 g of a polymer having an intrinsic viscosity, as determined in a 3:1 mixture of ethanol and water, of 0.73.

EXAMPLE 5

A 1,000 ml three-necked flask was charged with 172 g of 2-hydroxyethyl methacrylate, 28 g of methacrylic acid, 300 ml of methanol, 70 ml of isopropanol and 200 ml of distilled water, and, after purging of air with gaseous nitrogen, there were added thereto 0.89 g of potassium persulfate in solution in 50 ml of distilled water with heating to 60° C., and subsequently 0.34 g of sodium hydrogen sulfite in solution in 50 ml of distilled water. The mixture was stirred at 60° C. for 4 hours to effect polymerization. The polymerization mixture was then processed in the same manner as in Example 4 to obtain 190 g of a polymer having an intrinsic viscosity, as determined in solution in a 1:1 mixture of ethanol and water, of 1.27 and a methacrylic acid content, as determined by titration with 1 N aqueous sodium hydroxide, of 22.1 mole %.

EXAMPLE 6

A 2,000 ml three-necked flask was charged with 600 ml of ethanol and 300 ml of distilled water and equipped with a stirrer, a thermometer, a dropping funnel and a gaseous nitrogen introducing tube. The dropping funnel was then charged with 231 g of 2-hydroxyethyl methacrylate, 43.6 g of methacrylic acid and 25.4 g of methyl methacrylate, then there were dissolved therein 1.95 g of azobisisobutylonitrile. After purging the flask of air with gaseous nitrogen, the charge was stirred at 70° C. while dropping the mixture from the dropping funnel over about 40 minutes. Stirring was continued at 70° C. for an additional 4 hours. The reaction mixture was then stirred into 10 times its volume of cold water, and the resulting precipitate was put in running water for 24 hours and dried in a vacuum dryer to obtain 261 g of a polymer having an intrinsic viscosity, as determined in solution in a 3:1 mixture of ethanol and water, of 0.86.

EXAMPLE 7

A 1,000 ml three-necked flask was charged with 160.6 g of 2-hydroxyethyl methacrylate, 13.3 g of methacrylic acid, 26.1 g of diacetone acrylamide, 400 ml of N,N-dimethylacrylamide and 150 ml of distilled water. The flask was then purged of air with gaseous nitrogen with heating to a temperature of 80° C. After addition of 1.87 g of benzoyl peroxide in solution in 50 ml of N,N-dimethylformamide, the polymerization mixture was stirred at 80° C. for 5 hours. The mixture was then dialyzed for 25 hours in running water and dried in a freeze-dryer to obtain 185 g of a polymer having an intrinsic viscosity, as determined in solution in N,N-dimethylformamide, of 0.95.

EXAMPLE 8

A 500 ml flask was charged with 150 ml of methanol, 150 ml of distilled water, 67.8 g of 2-hydroxyethyl methacrylate, 15 g of methacrylic acid, 17.2 g of N,N-dimethylacrylamide and 1.3 g of triethanolamine. After purging of air with gaseous nitrogen, the mixture was heated to 50° C. and, after addition thereto of 1.75 ml of a 17% aqueous hydrogen peroxide, stirred at this temperature for 5 hours to effect polymerization. The mixture was then processed in the same manner as in Example 4 to obtain 89 g of a polymer of an intrinsic viscosity, as determined in solution in a 1:1 mixture of ethanol and water, of 0.62.

EXAMPLE 9

To a mixed solvent of 400 ml of water and 800 ml of ethanol there were added 300 g of 3-hydroxypropyl methacrylate and then 1 g of azobisisobutylonitrile and the reaction vessel containing the mixture was purged of air with gaseous nitrogen. The mixture was then stirred at 70° C. for 3½ hours, filtered and poured into 10 times its volume of cold water to precipitate the polymer. The precipitate was recovered by decanataion and dried in vacuo to obtain 260 g of a polymer having an average molecular weight of 570,000.

EXAMPLE 10

In a mixed solvent of 750 ml of water and 150 ml of ethanol there was dissolved at 60° C. 50 g of hydroxyethylcellulose. After purging of air with gaseous nitrogen, the temperature of the solution was raised to 75° C. and the solution was stirred at this temperature for 4 hours while dropping thereinto 50 g of 2-hydroxyethyl methacrylate containing dispersed therein 0.3 g of benzoyl peroxide. The mixture was then dialyzed for 20 hours in running water and dried in a freeze-dryer to obtain 88 g of a polymer.

EXAMPLE 11

In 100 ml of an 1:1 mixture of glycerol and water (by volume) there was dissolved 20 g of gelatin, then there were gradually added thereto 300 ml of a 3:1 (by volume) mixture of ethanol and water and then 20 g of 2-hydroxyethyl methacrylate and 1 g of benzoyl peroxide over about 10 minutes. The mixture was heated to 80° C. to complete polymerization in 120 minutes. The mixture was then cooled to 60° C. and, after 20 minutes, poured into water to obtain a fluffy precipitate. The precipitate was washed with water repeatedly, dehydrated by means of a centrifuge and dried in a vacuum dryer to obtain 92 g of a graft copolymer of a gelatin content, as determined by biuret reaction, of 48%.

Preparation of the polymer used in the present invention may be attained in any conventional process, e.g., in a solution polymerization process as disclosed in British Pat. Specification No. 1,211,039, or in block polymerization process, suspension polymerization process or emulsion polymerization process, and there may be employed, other than radical polymerization technique, anion or photo-polymerization technique for example.

The color image-forming material used in the present invention provides an imagewise distribution of diffusible dye corresponding to imagewise exposure as the result of development of a silver halide emulsion brought about by an imagewise exposure. There are various types of color image forming materials which have different mechanisms of formation of diffusible dye upon development of silver halide. Among these which can be suitably used in the manufacture of the photosensitive element of the present invention are ones such as the following:

(i) of the type varying its diffusibility as a result of oxidation by silver halide, (ii) of the type liberating a diffusible dye through reaction with an oxidized product of an auxiliary agent oxidized by silver halide, and (iii) of the type liberating a diffusible dye through reaction of an oxidized color image forming material with an auxiliary agent.

In the above three types of color image forming materials, oxidation by silver halide directly leads to formation of the diffusible dye. In addition to these, there can be used other color image forming systems including:

(iv) of the type employing a definite amount of a developing agent and transferring unoxidized developing agent to an image receiving element to form a dye, (v) of the type employing a definite amount of a developing agent and reacting unoxidized developing agent with a color image forming material to form a diffusible dye, (vi) of the type employing a defined amount of an agent capable of reacting with an oxidized product of a developing agent, such as a coupler and transferring unreacted remainder of the reactive agent to an image receiving element to form therein a dye, and (vii) of the type forming a diffusible dye by reacting a color image forming material with silver ions from undeveloped silver halide.

In these systems, a diffused color image is formed by the unreacted remainder of a reactive component from the developing or subsequent reaction step. Furthermore, there may be employed in the present invention a system:

(viii) of the type forming or destroying a mordant on the periphery of each particle of silver halide by development of silver halide particles thereby to fix or liberate a diffusible dye.

The color image forming material employed in the present invention may be one that contains a finished chromophoric system or a system capable of forming a chromophoric system through development and/or subsequent step or one that liberates a component which will transfer to an image receiving element to form therein a dye.

The color image forming material employed in the present invention may be one that contains a finished chromophoric system or a system capable of forming a chromophoric system through development and/or subsequent step or one that liberates a component which will transfer to an image receiving element to form therein a dye.

It is desired for the color image forming material employed in the color diffusion-transfer system of the present invention to be non-diffusible during the preparation, storage and exposure thereof, though it may possess variable degrees of diffusibilities during diffusion-transfer depending on the system of forming an imagewise distribution of dye. For instance, in one system, a diffusible color image forming material which is soluble in a processing composition decreases its diffusibility and is immobilized as a result of development and in undeveloped areas the color image forming material is transferred to an image receiving element. In another system, a color image forming material itself is non-diffusible in a processing composition but liberates a diffusible dye or diffusible dye precursor as a result of development. Any of the aforesaid color image forming materials may suitably be used in diffusion-transfer color photography in accordance with the present invention.

In the diffusion-transfer color photographic products of the present invention there may be employed a variety of dye image forming materials differing in the manner of forming dye image as mentioned above, among which most suitably used are:

(a) DYE DEVELOPERS

The dye developers are compounds which contain, in the same molecule, both the chromophoric system of a dye and also a silver halide developing function. Subjecting an exposed silver halide emulsion to the action of a dye developer in the presence of an alkali, there occurs reduction of the silver halide concurrently with oxidation of the dye developer. The oxidized dye developer possesses a lower solubility and a lower diffusibility in a processing composition than the original dye developer in reduced form and is immobilized in the neighboring reduced silver halide. It is preferred for the dye developer which is substantially insoluble in an acidic to neutral aqueous medium to have at least one dissociative residue capable of rendering the dye developer soluble and diffusible in an alkaline processing composition. The dye developer may be untilized in a silver halide emulsion layer, or it may be employed in a layer adjacent to the silver halide emulsion layer, and there is obtained a multi-colored positive image by a single development by diffusion-transfer to an image receiving element from a photosensitive element having at least two photosensitive units each comprising a silver halide emulsion sensitive to a specific wave length range associated with a dye developer having absorption characteristics in a final image corresponding to the said sensitive range of wavelengths. As suitable dye developers there are those having absorption ranges which make color reproduction by subtractive color process possible, namely, those providing yellow, magenta and cyan. The chromophoric systems providing such absorptions are derived from azo dyes, anthraquinone dyes, phthalocyanine dyes, nitro dyes, quinoline dyes, azomethine dyes, indamine dyes, indoaniline dyes, indophenol dyes, azine dyes and the like. On the other hand, by "a silver halide developing function" is meant a grouping adapted to develop exposed silver halide and preferably such that loses hydrophilicity as a result of oxidation. In general, benzoid developing functions, i.e., aromatic developing functions which will form quinonoid substance when oxidized are suitable. A preferred developing function is a hydroquinonyl group and other suitable developing functions include ortho-dihydroxyphenyl and ortho- and para-amino substituted hydroxyphenyl groups. In the preferred dye developers, the chromophoric system and developing function are interrupted by a divalent organic radical containing at least one methylene group so as to hinder electronic conjugation therebetween. Especially, 2-hydroquinonylethyl and 2-hydroquinonylpropyl groups are useful. Other than being linked by covalent bond, the chromophoric system and developing function may be linked together by coordinate bond, as disclosed in U.S. Pat. Nos. 3,551,406, 3,563,739, 3,597,200 and 3,674,478. The entire disclosures of the patents are hereby incorporated by reference.

In accordance with the use and structure of diffusion-transfer color photographic products, it is advantageous to previously reduce the chromophoric system temporarily into a colorless leuco form, as disclosed in U.S. Pat. No. 3,230,082, and to previously acylate a hydroxyl or amino group to temporarily shift the absorption to shorter wavelengths, as disclosed in U.S. Pat. Nos. 3,230,082 and 3,307,947. The entire disclosures of these two patents is hereby incorporated by reference. Dye developers of the type having a hydroxyl group in ortho-position to an azo linkage in the chromophoric system are useful because of the excellent absorption characteristics and stability of the dye image formed. Other dye developers adapted for employment in photographic diffusion transfer color processes are disclosed in, e.g., U.S. Pat. Nos. 2,983,605, 2,992,106, 3,047,386, 3,076,808, 3,076,820, 3,077,402, 3,126,280, 3,131,061, 3,134,762, 3,134,765, 3,135,604, 3,135,605, 3,135,606, 3,135,734, 3,141,772, 3,142,565, 3,173,906, 3,183,090, 3,246,985, 3,230,086, 3,309,199, 3,230,083, 3,239,339, 3,347,672, 3,347,673, 3,245,790 and 3,230,082. The entire disclosures of these patents are hereby incorporated by reference.

Specific examples of dye developers adapted for diffusion transfer color photographic processes are, e.g., 4-[p-(β-hydroquinonyl)phenylazo]-3-[N-n-hexylcarbamoyl]-1-phenyl-5-pyrazolone, 2-[p-(β-hydroquinonylethyl)phenylazo]-4-isopropyl-1-naphthol, 1,4-bis-[p-(β-hydroquinonyl-α-methyl-ethyl)-ethylamino]-5,8-dihydroxyanthraquinone,

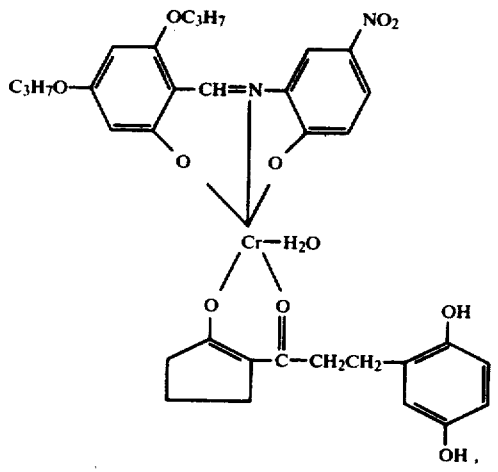

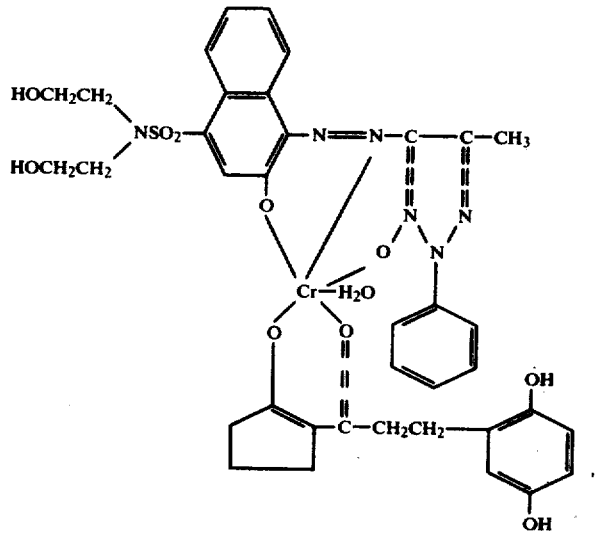

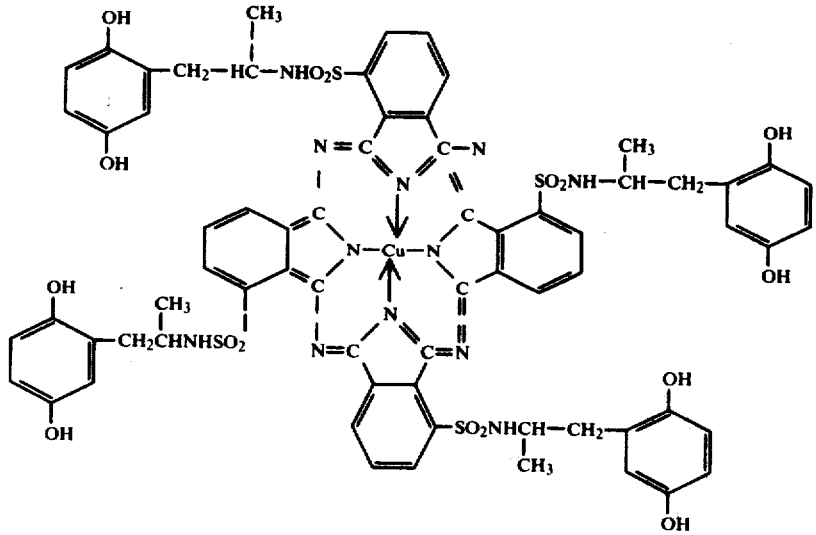

In a diffusion transfer color photographic process in which there is employed a dye developer as a dye image forming material, it is preferred to utilize a developing aid for quickly advancing development. For this purpose, there may be incorporated in the processing composition or a silver halide emulsion layer, dye developer layer, interlayer or overcoating protective layer of the photosensitive element a developer such as 1-phenyl-3-pyrazolidone, as disclosed in U.S. Pat. No. 3,039,869, 4'-methylphenylhydroquinone, tert.-butylhydroquinone and like hydroquinone derivatives, as disclosed in West German Pat. Nos. 1,422,848 and 1,422,849, and catechol derivatives, as disclosed in U.S. Pat. No. 3,617,277, British Pat. No. 1,243,539 and Japanese Patent applications Nos. 82274/1972 and 125611/1972. In addition, for accelerating development and diffusion transfer, there may be utilized N-benzyl-α-pyrrolonium bromide and like onium compounds, as disclosed in U.S. Pat. No 3,173,786. The entire disclosures of the United States patents mentioned in this paragraph are hereby incorporated by reference as are the disclosures of the German and British patents.

(b) DIFFUSIBLE DYE-LIBERATING COUPLERS

The couplers are non-diffusible reactive compounds capable of coupling with an oxidized developing agent to form a dye which is soluble and diffusible in the processing composition. The first type of diffusible dye-liberating couplers contains a system in which a coupling site has been substituted by a residue to be liberated by the action of an oxidized developing agent. The electronic conjugation system of the dye to be liberated may previously be provided in the coupler or it may be formed by coupling. The former is called "ready-made type" and the coupler of this type exhibits a spectral absorption closely resembling that of the dye to be liberated. The latter, on the contrary, is called "instant forming type" and the couplers of this type exhibit a temporal spectral absorption having no direct relationship with that of the dye to be liberated regardless of the color of the coupler.

Representative diffusible dye-liberating couplers of the two types are represented by the following general formulae:

(1) (Cp-1)-L-(Fr) (Ready-made type), and (2) (Cp-2)-L-(Bl) (Instant forming type), where, in the above formulae, Cp-1 represents a coupling-susceptible moiety substituted in its coupling site by a (Fr)-L- residue and in at least one of its non-coupling sites by a residue containing a hydrophobic group of at least 8 carbon atoms for rendering the coupler molecule non-diffusible, Cp-2 represents a coupling-susceptible moiety substituted in its coupling site by a (Bl)-L- residue, Cp-2 should have a water-solubilizing group on at least one of its non-coupling sites when the coupler is utilized in combination with a developing agent having no water-solubilizing group, and (Fr)-L- and (Bl)-L- represents such groups which are to be liberated by the action of oxidized developing agent, Fr represents a chromophoric system having absorption bands in the visible region of wave length and containing at least one water-solubilizing group, and Bl represents a moiety containing a hydrophobic group of at least 8 carbon atoms for rendering the coupler molecule non-diffusible.

The coupling-susceptible systems, utilized as Cp-1 and Cp-2, include many functional groups which are known to be capable of oxidatively coupling with an aromatic primary amino color developing agent, such as residues of phenols, anilines, cyclic or linear active methylene compounds and hydrazones. Examples of the active moieties most suitably utilized are: residues of acylamino-substituted phenols, 1-hydroxy-2-naphthoamide, N,N-dialkylanilines, 3-alkyl-, - aryl-, -alkoxy-, aryloxy-, -alkoxy-, -amino-, -acylamino-, -ureido- or -sulfonamido-1-aryl-pyrazolones, pyrazolobenzimidazole, pyrazolotriazole, α-cyanoacetophenone and α-acylacetanilides.

The bridge group L, the bond between the group and the coupling moiety which is to be severed by oxidized developing agent, includes azo, azoxy, divalent mercury (—Hg—), oxy, thio, dithio, triazolyl, diacylamino, acylsulfonamino

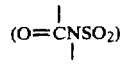

$$(O{=}\overset{|}{\underset{|}{C}}NSO_2)$$

acyloxy, sulfonyloxy, alkylidene and like divalent groups. Among those, oxy, thio, dithio, diacylamino, acyloxy and like groups which are separated from the coupling moiety in the form of anion are preferred because they liberate a larger quantity of a diffusible dye. It is preferred that the coupling site of the coupling moiety consisting of a residue of a phenol or naphthol has been substituted by a moiety through an oxy, thio or diacyloxy group, that the coupling site of pyrazolone is by an azo, thio or acyloxy group, and that the coupling site of an acylacetoanilide is by an oxy, thio or diacylamino group.

Representative examples of the chromophoric systems Fr are residues derived from azo dyes, azomethine dyes, indoaniline dyes, indophenol dyes, anthraquinone dyes, nitro dyes and azine dyes.

The hydrophobic group contained in a residue represented by Cp-1 and Bl imparts an enhanced cohesive force between coupler molecules in an aqueous medium and, thereby, renders the coupler non-diffusible in a hydrophilic colloid utilized as an integral component of photosensitive products, and includes substituted or unsubstituted alkyl, alkenyl, aralkyl, and alkylaryl groups containing at least 8 carbon atoms, such as, e.g., octyl, lauryl, stearyl, oleyl, 3-n-pentadecylphenyl and 2,4-di-tert.-amyl-phenoxy groups. The hydrophobic group is bonded directly or through an amido, ureido, ether, ester, sulfonamide or like divalent radical to a coupling susceptible system to form Cp-1. The hydrophobic group forms Bl either alone or in combination directly or through one of the aforesaid bivalent radical with an aryl or heterocyclic group.

The water-solubilizing group contained in the residue represented by Cp-2 and Fr is an acidic group which substantially dissociates in a processing composition or a precursor group converted by hydrolysis into such an acidic group. Preferred are acid groups of a pKa of at most 11, such as, e.g., sulfo, sulfate (—$OSO_3H$), carboxyl, sulfonamide, diacylamino, cyanosulfonamino and phenolic hydroxyl groups.

The diffusible dye-liberating- coupler represented by the general formula (1) is severed, upon reaction with oxidized developing agent, at the linkage L to form a non-diffusible condensate of Cp-1 and developing agent and a soluble dye containing Fr-moiety which will then diffuse into an image receiving element or layer to form a dye image.

The diffusible dye-liberating coupler of the type represented by the general formula (2) provides, upon reaction with oxidized developing agent, a soluble dye which is an oxidative coupling product of Cp-2 and developing agent and a non-diffusible liberated product derived from Bl-L-, through fission between L and Cp-2. The soluble dye thus formed diffuses into an image receiving element to form a dye image.

Examples of the diffusible dye-liberating couplers represented by the general formula (1) are: alpha-[4-(8-acetamide -3,6-disulfo-1-hydroxy-2-naphthylazo(-phenoxy]-alpha-pivalyl-4-(N-methyl-N-octadecylsulfamyl)acetanilide disodium salt, 1-(p-tert.-butyl-phenoxyphenyl)-3-[alpha-(4-tert.-butylphenoxy)-propionamido]-4-(2-bromo-4-methylamino-5-sulfo-1-anthra-9,10-quinolazo)-5-pyrazone and 1-hydroxy-4-{3-[4-(N-ethyl-N-beta-sulfoethylamino)-2-methylphenylazo]-N-[delta-(2,4-di-tert.-amylphenoxy)butyl]-2-naphthamide} sodium salt.

Examples of the diffusible dye-liberating couplers represented by the general formula (2) are: alpha (4-methoxybenzoyl)-alpha-(octadecylcarbamylphenylthio)-3,5-dicarboxylacetamide, alpha-pivalyl-alpha-(3-octadecylcarbamylphenyltio)-4-sulfoacetanilide potassium salt, 1-phenyl-3-(3,5-dicarboxyanilino)-4-(3-octadecyl-carbamylphenylthio)-5-pyrazolone, 1-phenyl-3-(3,5-disulfobenzoyl-amino)-5-(2-hydroxy-4-n-pentadecylphenylazo)-5-pyrazolone, 1-[4-(3,5-dicarboxybenzamido)phenyl]-3-ethoxy-4-(3-octadecylcarbamylthio)-5-pyrazolone, 1-hydroxy-4-(3-octadecylcarbamylphenylthio)-N-3',5'-dicarboxy-2-naphthanilide, and 1-hydroxy-4-(n-octadecylsuccinimido)-N-ethyl-3'-5'-dicarboxy-2-naphthanilide.

Other examples of special diffusible dye-liberating couplers and processes for synthesis thereof are disclosed in British Pat. Nos. 840,731, 904,364 and 1,085,631 and U.S. Pat. Nos. 3,476,563, 3,644,498 and 3,419,391. The entire disclosures of the United States and British patents set forth in this paragraph are hereby incorporated by reference.

In the case of the second type of diffusible dye-liberating coupler, subsequent to the condensation with oxidized developing agent, there occurs intramolecular ring closure between the substituent in the vicinal position to the reaction point with liberation of a chromophoric residue from the substituent. Especially useful is the reaction system in which an aromatic primary amine developing agent oxidatively couples to the 4-position of a phenol or aniline and the coupled residue of the coupler reacts with the sulfonamide group containing a chromophoric system, located on the 3-position of the phenol or aniline, to form an azine ring with liberating a diffusible dye containing sulfonic group. Examples of this type of compound are: 1-phenyl-3-ethylcarbamoyl-4-{2-methoxy-4-[N-n-dodecyl-N-(1-hydroxy-4-chloro-3-naphthyl)]sulfamylphenylazo}-5-pyrazolone, 2-(beta-octadecyl-carbamoylethyl)-4-{-[(2-hydroxy-1-naphthylazo)phenylsulfonamido]-anilino}-phenol and the like.

As the aromatic primary amino developing agent suitably used in combination with the diffusible dye-liberating couplers are p-aminophenol, p-phenylenediamines and derivatives thereof, such as, e.g., 2-chloro-4-aminophenol, 2,6-dibromo-4-aminophenol, 4-amino-N,N-diethyl-3-methylaniline, N,N-diethyl-p-phenylenediamine, N-ethyl-beta-methanesulfonamidoethyl-3-methyl-4-aminoaniline, 4-amino-N-ethyl-N-(delta-sulfobutyl)-aniline, 4-amino-N-ethyl-N-beta-hydroxyethyl)aniline, 4-amino-N-ethyl-N-(beta-carboxyethyl)-aniline, 4-amino-N,N-bis-(beta-hydroxyethyl)-3-methylaniline, 3-acetamido-4-amino-N,N-bis-(beta-hydroxyethyl)aniline, 4-amino-N-ethyl-N-(2,3-dihydroxypropyl)-3-methylaniline, 4-amino-N,N-diethyl-3-(3-hydroxypropoxy)aniline, 4-amino-N-ethyl-N-(beta-hydroxyethyl)-3-methoxyaniline, and hydrochlorides, sulfates, oxalates, p-toluenesulfonates and like salts thereof, and precursors of such developing agents, such as Schiff's bases and phthalimides thereof, are conveniently incorporated in the photosensitive products.

A negative type of silver halide emulsion layer containing a diffusible dye-liberating coupler provides, upon development, a diffusion-transfer dye image of negative type. On the contrary, a direct positive type of silver halide emulsion layer containing a diffusible dye-liberating coupler provides a positive diffusion-transfer dye image. As the direct positive type emulsions suitably used are emulsions of the type having internal latent image as disclosed in, e.g., U.S. Pat. Nos. 2,592,250, 2,588,982 and 3,227,552, and emulsions of the fogged type as disclosed in e.g., British Pat. Nos. 443,245 and 462,730 and U.S. Pat. Nos. 2,005,837, 2,541,472 and 3,367,778. By treating a layer containing a diffusible dye-liberating coupler and physical centers of development adjacent a negative type of silver halide emulsion layer by a developing solution containing a silver halide solubilizer, there is obtained a positive type of diffusion-transferred dye image. As the reversal dye image forming technique utilizing the physical development there may be applied a technique as disclosed in British Pat. No. 904,364. As disclosed in U.S. Pat. Nos. 3,227,551, 3,227,554, and 3,364,022 and West German Open Patent Specification No. 2,032,711, a photographic element having a negative type of silver halide emulsion layer containing a compound which reacts with oxidized developing agent to liberate a development inhibitor compound such as 1-phenyl-5-mercaptotetrazole (DIR compound) and an adjacent layer containing a diffusible dye-liberating coupler, and a metallic salt capable of autogeneously reducing the coupler, provides a positive diffusion-transferred dye image. In the photographic processes of the present invention, there may be employed suitable combinations of these emulsions and diffusible dye liberating couplers, and according to the purpose, negative processes or positive processes are selected. The entire disclosures of all of the United States patents, British patents and German patent specifications set forth in this paragraph are hereby incorporated by reference.

(c) DIFFUSIBLE DYE-LIBERATING REDUCING AGENT

In the photographic product of the present invention, in addition to the aforesaid dye developer and diffusible dye-liberating coupler, there may suitably be used as dye image-forming material a reducing agent which is oxidized during development and wherein the oxidized product liberates a diffusible dye through intramolecular reaction or reaction with an auxiliary agent contained in the developing solution. In this type of dye image formation, it is preferred to oxidize the dye image-forming material through a hydroquinone, 3-pyrrazolidone or like auxilizry developing agent. Oxidized dye image-forming material liberates a diffusible dye as a result of action of an auxiliary reagent, such as hydroxide ion or sulfite ion, contained in the photographic product or processing composition. Special examples of this type of dye image-forming materials are disclosed in U.S. Pat. Nos. 3,685,026 and 3,698,897 and West German Open Patent Specification No. 2,242,762. The entire disclosure of the two United States patents and the German Specification set forth in this paragraph are hereby incorporated by reference.

The dye image-forming material used in the photographic element of the present invention may be dispersed in a hydrophilic colloid as carrier by various techniques according to the type of the dye image-forming materials utilized. For instance, such compounds as diffusible dye-liberating couplers containing sulfoxyl, carboxyl or like dissociative groups may be added to a hydrophilic colloid solution in water or an aqueous alkali, e.g., sodium hydroxide. A material which is insoluble or slightly soluble in water, but easily soluble in organic solvents is first dissolved in an organic solvent and the resulting solution is added to a hydrophilic colloid solution and is finely dispersed therein by means of, e.g., stirring. As the organic solvents suitably there can be used, e.g., ethyl acetate, tetrahydrofurane, methyl ethyl ketone, cyclohexanone, beta-butoxy-beta-ethoxyethyl acetate, dimethylformamide, dimethylsulfoxide, 2-methoxyethanol and tri-n-butyl phthalate. Among these solvents, those having relatively low vapor pressures may be volatilized during drying of photographic layers or may be volatilized from the coating solution prior to application thereof to form photographic elements in the processes as disclosed in U.S. Pat. Nos. 2,322,027 and 2,801,171. Among these solvents those soluble in water may be eliminated by washing with water in the manner as disclosed in U.S. Pat. Nos. 2,949,360 and 3,396,027. The entire disclosures of the United States patents mentioned in this paragraph are hereby incorporated by reference.

It is preferred for stabilizing dispersions of the dye image-forming material and facilitating formation of dye image to incorporate in the photosensitive element a substantially water-insoluble solvent having a boiling point under normal pressure of at least 200° C. together with the dye image-forming material, such as, e.g., triglycerides of higher fatty acids, e.g., glyceryl tristearate, glyceryl trioleate, dioctyl adipate and like fatty acid esters, di-n-butyl phthalate and like phthalates, tri-o-cresyl phosphate, tri-n-hexyl phosphate and like organic phosphates, N,N-diethylformamide and like amides, 2,4-di-n-amylphenol and like hydroxy compounds. It is preferred for stabilizing dispersions of dye image-forming material and facilitating formation of diffusion-transferred dye image to incorporate in the photosensitive element, together with the dye image-forming material, a lyophilic natural or synthetic polymer, such as, e.g., shellac, phenol-formaldehyde condensate, poly(n-butyl acrylate), copolymers of n-butyl acrylate and acrylic acid, and a copolymer of n-butyl acrylate, ethyl acrylate, styrene and methacrylamide. The polymer may be dispersed in a hydrophilic colloid by dissolving it in a suitable organic solvent together with a dye image-forming material and dispersing the resulting solution in the hydrophilic colloid solution, or alternately, by adding to a hydrophilic colloid dispersion of the dye image-forming material a hydrosol of said polymer prepared by, e.g., emulsion polymerization.

Dispersion of a dye image-forming material in a hydrophilic colloid is effectively attained in general by the action of a high shearing force, by means of, e.g., a high speed rotary mixer, a colloid mill, a high pressure milk homogenizer, a high pressure homogenizer as disclosed in British Pat. No. 1,304,264 and an ultrasonic emulsifier. Dispersion of a dye image-forming material is promoted remarkably by using a surface active agent as an emulsifying aid. It is preferred for the dispersion of a dye image-forming material prepared in accordance with the present invention to be of a particle size, in coating film, of 5 microns or less, more desirably within the range of 0.1 to 0.5 microns. Of course, dispersions of particle sizes less than 0.1 micron may also be used without any trouble.

The surface active agents suitably used in the present invention for dispersion of dye image-forming materials include, e.g., sodium triisopropylnaphthalenesulfonate, sodium dinonylnaphthalene-sulfonate, sodium p-dodecylbenzenesulfonate, sodium dioctylsulfosuccinate, sodium cetylsulfate and anionic surface active agent as disclosed in Japanese Patent Specification Publication No. 4293/1964. A combination of such an anionic surface active agent with a higher fatty acid ester of anhydrohexitol, such as disclosed in U.S. Pat. No. 3,676,141, exhibits extremely high emulsifying power and is effecitvely utilized in the practice of the present invention. The entire disclosure of U.S. Pat. No. 3,676,141 is hereby incorporated by reference.

The silver halide emulsions used in the present invention include colloidal dispersions of silver chloride, silver bromide, silver chlorobromide, silver iodobromide, silver chloroiodobromide, and mixtures thereof, and, although the proportions of halogens are chosen appropriately depending on the use and processing condition of the photosensitive elements, in general there are preferably used silver iodobromide and silver chloroiodobromide of an iodide content of 1 to 10 mole % and a chloride content of at most 30 mole %, the balance being bromide. It is preferred for the dispersion of silver halide to be of an average particle size of about 0.1 to about 2 microns and, in certain uses of the photographic elements, to be of uniform particle size. The particles may be in the form of cubes, octahedron or mixture. The silver halide emulsions may be prepared in the conventional manner, e.g., as described by P. Glafkides in "Chimie Photographique", Second edition, Chapters 18–23 (1957), Paul Montal, Paris. For instance, a soluble silver salt such as silver nitrate and a water-soluble halide such as potassium bromide are reacted in a solution of a protective colloid such as gelatin and the reaction mixture is then aged in the presence of excess of silver halide or a silver halide solubilizer such as ammonia as to effect growth of crystals. There can be employed a single or double jet process, PAg control double jet process or like precipitation process. Removal of soluble salts from the emulsion is attained by subjecting the cooled and gelatinized emulsion to washing with water or dialysis, or by sedimentation effected by addition of a sedimentating agent such as an anionic polymer containing, e.g., sulfonate, sulfate or carboxyl groups or an anionic surface active agent and adjustment of pH or it can be effected by use of an acylated protein such a phthaloylgelatin and adjustment of pH. It is preferred for the silver halide emulsion employed in the present invention to have been chemically sensitized by heat treatment in the presence of a naturally occurring sensitizer such as is contained in gelatin, a sulfur sensitizer such as sodium thiosulfate or N,N,N'-trimethylthiourea, a gold sensitizer such as a thiocynate or thiosulfate complex of monovalent gold or a reductive sensitizer such as stannous chloride or hexamethylenetetramine. In the photographic products of the present invention there may be utilized an emulsion which tends to form latent image on the surfaces of silver halide particles and also an emulsion having a tendency to forming latent image inside the particles as disclosed in U.S. Pat. Nos. 2,592,550 and 3,206,313. The entire disclosures of these two United States patents are hereby incorporated by reference.

The silver halide emulsion used in the present invention may be stabilized by an additive such as, e.g., 4-hydroxy-6-methyl-1,3,3a, 7-tetrazaindene, 5-nitrobenaimidazole, 1-phenyl-5-mercaptotetrazole, 8-chloromercuriquinoline, benzenesulfinic acid, pyrocatechin, 4-methyl-3-sulfoethylthiazolidine-2-thione or 4-phenyl-3-sulfoethylthiazolidine-2-thione. In addition, cadmium salts, mercury salts, complex salts of the platinum group metals such as chloro complex salts of palladium, and like inorganic compounds are also useful for stabilization of the photosensitive material of the present invention. Furthermore, the silver halide emulsion used in the present invention may contain poly(ethylene oxide) compounds and like sensitizing compounds.

The silver halide emulsion used in the present invention can possess a color sensibility suitably extended by means of a spectral sensitizer, such as cyanines, melocyanines, holopolar cyanines, styryls, hemicyanines, oxanols and hemioxanols. Examples of the spectral sensitizers are described in the above mentioned book by P. Glafkides, Chapter 35–41, and in "The Cyanine and Related Compounds" (interscience Publishers Inc.) by F. M. Hamer. Especially useful in the practice of the present invention are cyanines in which nuclear nitrogen atom is substituted by an aliphatic group containing a hydroxyl, carboxyl or sulfoxyl group, as, e.g., disclosed in U.S. Pat. Nos. 2,503,776, 3,459,553 and 3,177,210. The entire disclosures of these three United States patents and the Galfkides book is hereby incorporated by reference.

The processing liquid permeable layers, such as silver halide emulsion layers, dye image forming material-containing layers, etc., contain a hydrophilic polyemr as a binder, such as, e.g., gelatin, casein, acylated or otherwise modified gelatins, vinyl polymer-grafted gelatins, albumen and like proteins. cellulose derivatives such as hydroxyethylcellulose, methyl cellulose and carboxymethylcellulose, polyvinyl alcohol and partial hydrolysates of polyvinyl acetate, polyvinylpyrrolidone, polyacrylamide and like high molecular electrolytes, polyacrylic acid, partial hydrolysates of polyacrylamide, anionic synthetic polymers such as vinyl methyl ether-maleic acid copolymers, and amphoteric synthetic polymers such as N-vinyl-imidazole-acrylic acid-acrylamide terpolymers and Hoffman's reaction products of polyacrylamide. These hydrophilic polymers may be used, in the practice of the present invention, either alone or in mixtures thereof. In addition, the hydrophilic polymers may contain a latex of a hydrophobic polymer, such as, for example, of a poly(alkyl acrylate) or poly(alkyl methacrylate), e.g., poly(ethyl acrylate) or poly(propyl methacrylate).

The hydrophilic polymers mentioned in the preceding paragraph may be used either alone or in combination with the polymer in accordance with the present invention in protective overcoating layer and/or interlayers. The hydrophilic polymer of the preceding paragraph may be blended in any proportions with the polymer of the present invention. The proportion is generally less than 10,000 parts, preferably less than 100 parts, most preferably less than 10 parts of the hydrophilic polymers mentioned in the preceding paragraph to 1 part of the polymer of the present invention.

The thickness of the protective overcoating layer and interlayers is not limited, however, that of both layers is generally about 0.01 to about 30 microns, preferably about 0.1 to about 10 microns, most preferably about 0.5 to about 5 microns.

The photographic layers in the photosensitive products of the present invention may be applied by various coating methods, e.g., dip coating method, roller coating method, air-knife coating method, bead coating method as disclosed in U.S. Pat. No. 2,681,294, and the curtain coating method as disclosed in U.S. Pat. Nos. 3,508,947 and 3,513,017. In the case especially of multilayer photographic elements, it is preferred to apply multilayers concurrently by means of a multi-slit hopper as disclosed in U.S. Pat. Nos. 2,761,417, 2,761,418, 2,761,419 and 2,761,791. The entire disclosures of the United States patents set forth in this paragraph are hereby incorporated by reference.

The coating compositions employed to form photographic layers may contain for ease of application a surface active agent as a coating aid, such as, e.g., saponin; ethylene oxide adducts of p-nonylphenol, sucrose alkyl ethers, monoalkyl ethers of glycerol and like nonionic surface active agents; sodium dodecylsulfate, sodium p-dodecylbenzenesulfonate, sodium dioctylsulfosuccinate and like anionic surface activw agents, carboxymethyl dimethyl lauryl ammonium inner salt, "Deriphat 151", Betaine compounds as disclosed in U.S. Pat. No. 3,441,413, British Pat. No. 1,159,825 and U.S. Pat. No. 3,545,974, and like amphoteric surface active agents.

The coating composition may contain, for ease of application, a thickening agent. As the thickening agent there may be used other than those that increase the viscosity of the coating composition by virtue of their own high viscosity such as high molecular weight polyacrylamide, those that increase the viscosity by interaction with the polymeric binder in the coating composition such as, e.g., cellulose sulfate, potassium salt of poly(p-sulfostyrene) and acrylic polymers as disclosed in U.S. Pat. No. 3,655,407, the entire disclosure of which is incorporated by reference.

The composition employed in the process of the present invention is a liquid composition containing some of the ingredients necessary for development of the silver halide emulsion and formation of diffusion transfer dye image, in which the solvent consists mainly of water and optionally may contain a hydrophilic solvent, such as methanol or 2-methoxyethanol. The composition employed in the process contains an alkali in an amount sufficient to maintain its pH at a value necessary for effecting development of the emulsion layer and to neutralize acidic matter formed during development formation of the dye image. The alkali used can be, for example, sodium hydroxide, calcium hydroxide dispersion, tetramethylammonium hydroxide, sodium carbonate, trisodium phosphate and diethylamine, and is preferably used in an amount so as to give the composition a pH of at least about 12 at room temperature. More desirably, the composition also contains a high molecular weight polyvinyl alcohol, hydroxyethylcellulose, sodium carboxymethylcellulose or like hydrophilic polymer which will given the composition a viscosity at room temperature of at least 1 poise, preferably about 1,000 poises to facilitate uniform spread of the composition upon processing and, in addition, to form a nonflowable film to aid unification of the film unit after processing when the processing composition is concentrated by transfer of the aqueous medium therefrom into the photosensitive element and the image receiving element. The polymer film will inhibit, after substantial completion of formation of the diffusion transfer dye image, further transfer of the dye or dye-forming component to the image receiving element to prevent alteration of the dye image.

The processing composition may contain carbon black or like photoabsorptive substance or desensitizer disclosed in U.S. Pat. No. 3,579,333 for preventing the silver halide emulsions from being fogged during the processing. It is preferred for the processing composition to contain processing ingredients peculiar to the dye image-forming material used. Examples of such ingredients are: in the case of dye developing agents, p-aminophenol, 4'-methyl-phenylhydroquinone, 1-phenyl-3-pyrazolidone and like auxiliary developing agents, N-benzylalpha-pyrrolinium bromide and like onium development promotors and benzotriazole and like antifogging agents and, in case of diffusible dye-liberating couplers, aromatic primary amino color developers and like developers, inorganic sulfites, ascorbic acid and like antioxidants, halogen compounds, 5-nitrobenzimidazole and like antifogging agents and thiosulfates, uracil and like silver halide solubilizers.

The image receiving element used in the present invention immobilizes or fixes dye image ofrming substances such as diffusible dyes liberated in imagewise distributions from the dye image-forming materials associated with the respective silver halide emulsions. In the case where the dye image-forming material is a dye developer having a hydroquinonyl group, dye-forming compound having an acidic water-solubilizing group or like anionic compound, the image receiving element preferably is comprised of a basic polymer or basic surface active agent. As the basic polymer, there are suitably used those containing tertiary or quaternary nitrogen atoms, such as, e.g., polymers of amino-guanidine derivatives of vinyl methyl ketone disclosed in U.S. Pat. No. 2,882,156 (the entire disclosure of which is incorporated by reference) poly(4-vinyl-N-benzylpyridinium p-toluene-sulfonate), poly(3-vinyl-4-methyl-N-n-butylpyridinium)bromide, styrene/N-(3-maleimidopropyl)-N,N-dimethyl-4-phenylbenzylammonium chloride copolymers disclosed in British Pat. No. 1,262,925, and poly[N-(2-methacryloethyl)-N,N-dimethyl-N-benzylammonium chloride]. As the basic surface active agent there are suitably used those containing both an ammonium, sulfonium, phosphonium or like onium residue and a hydrophobic residue such as a long chain alkyl group, e.g., N-laurylpyridinium bromide, cetyl trimethylammonium bromide, methyl-tri-n-laurylammonium p-toluenesulfonate, methyl-ethyl-cetylsulfonium iodide and benzyl-triphenylphosphonium chloride. In addition to these basic compounds, compounds of zirconium and like polyvalent metals also possess a fixing or immobilizing function on the anionic dye-forming substances, It is preferred to form an image receiving film or layer with such a substance in combination with a gelatin, especially acid treated gelatin, polyvinyl alcohol, polyacrylamide, polyvinyl methyl ether, hydroxyethylcellulose, N-methoxymethylated poly(hexamethylene adipamide), polyvinylpyrrolidone or like water soluble film-forming polymer. In the case where the dye image-forming material is the combination of plural dye-forming components, such as a diffusible coupler, the image receiving layer contains another coupling component that reacts with the aforesaid component to form a dye, such as a combination of a p-phenylenediamine derivative with an oxidizing agent or a diazonium compound. As the image receiving element of this type there may be employed those as disclosed in U.S. Pat. Nos. 2,647,049, 2,661,293, 2,698,244, 2,698,789, 2,802,735 and 3,676,124 and British Pat. Nos. 1,158,440 and 1,157,507. The entire disclosure of the United States and British patents mentioned in this paragraph are hereby incorporated by reference.

It is preferred for the diffusion-transfer film units of the present invention to possess the function of neutralizing alkali introduced therein by the processing composition. The processing composition contains an alkali to give a pH of at least 10, preferably of at least 11, sufficient to promote the image forming process comprising development of the silver halide emulsions, formation and diffusion of diffusion dye image-forming materials. After substantial completion of formation of the diffusion transfer image, the alkali contained in the film unit should be neutralized to pH around neutrality, namely, less than 9, preferably less than 8 and most preferably about 7 to stop further advancement of the image forming process and thereby to prevent the tone of the image from change with the passage of time and to inhibit the discoloration of the image and the staining of the brown to white background of the image induced by a high alkalinity. For this purpose, it is preferred to incorporate in the film unit a layer containing an acidic substance in an amount sufficient to neutralize the alkali contained in the processing composition to the aforesaid pH, i.e., containing an acidic substance in an amount at least equivalent to the alkali in the spread processing composition. As the acidic substance there are suitably used compounds having a carboxylic or sulfonic acid group and having a pK value not exceeding 9 or precursors of such compounds convertible by hydrolysis into such compounds. Specific examples are: oleic acid and like higher fatty acids such as those disclosed in U.S. Pat. No. 2,983,606, and polymers of acrylic, methacrylic or maleic acid including half esters of maleic acid and maleic anhydride as disclosed in U.S. Pat. No. 3,362,819. Examples of the high molecular weight acidic substances are: copolymers of maleic anhydride with ethylene, vinyl acetate, vinyl methyl ether or like vinyl monomer and n-butyl half-ester of maleic acid, copolymers of butyl acrylate with acrylic acid and the acidic phthalate of acetylcellulose. The neutralizing layer may contain, in addition to these acidic substances, a polymer such as polyvinyl acetate and, as disclosed in U.S. Pat. No. 3,557,237, a plasticizer, and can have been cured by cross-linking by a polyfunctional aziridine compound, epoxy compound, etc. The neutralizing layer may be located in image receiving element and/or photosensitive element, preferably between the support and image receiving layer of an image receiving element. The acidic substance may be incorporated in the film unit in the form of micro-capsules, as disclosed in West German Pat. No. 2,038,254. The entire disclosures of the United States patents and the German patent set forth in this paragraph are hereby incorporated by reference.

The neutralizing or acidic substance-containing layer employed in the film unit of the present invention is preferably spaced from the spread layer of the processing solution by a neutralizing rate-controlling layer which delays the lowering of pH until the development and transfer proceed to the desired extent to prevent an undesirable decrease in the density of the transferred image caused by premature lowering of the pH of the processing solution by the action of the neutralizing layer prior to proceeding to the desired extent of development and formation of the diffusion-transfer image. In a preferred embodiment of the present invention, the image receiving element possesses a multilayer arrangement comprising a support, a netutralizing layer, a neutralizing rate controlling layer and a mordant or image receiving layer arranged in this order. The neutralizing rate controlling layer consists essentially of a polymer, such as, e.g., gelatin, polyvinyl alcohol, poly(vinyl propyl ether), polyacrylamide, hydroxypropyl-methylcellulose, partial polyvinyl butyral, partially hydrolyzed polyvinyl acetate, copolymers of beta-hydroxyethyl methacrylate with ethyl acrylate or the like. It is preferred to cure the polymers by cross-linking with, e.g., formaldehyde or like aldehyde compound or an N-methylol compound, e.g., dimethylol urea or trimethylol melamine. The neutralizing layer is preferably of a thickness of 2 to 20 microns.

As the support there are suitably used in the present invention flat materials having good dimensional stability against the processing composition. Although there may be used sheet glass and like rigid supports if desired, in general pliable supports are more useful. As the pliable supports there may conveniently be used those conventionally used with the ordinary photosensitive materials, such as nitrocellulose film, acetylcellulose film, polyvinyl acetal film, polystyrene film, poly(ethylene terephthalate) film, polycarbonate film and like plastic film. Dimensionally stable and oxygen interceptive supports, such as a laminate comprising a polyvinyl alcohol layer interposed between a pair of poly(ethylene terephthalate) or acetyl cellulose layers, are especially desirable because of good stability of the dye image and little stain. It is advantageous to employ a water vapor-permeable support, as disclosed in U.S. Pat. No. 3,573,044, to assist water contained in the spread processing composition evaporating through the support. It is desirable that the transparent support be colored to such a degree as to prevent transmission of light in the direction of the plane of the support but not to obstruct imagewise exposure and observation in the direction perpendicular to the plane, in order to prevent the silver halide emulsion layers from penetration thereinto from the edges of the support during processing of the film unit in a light place. The support may contain, if desired, organic phthalates, e.g., dibutyl phthalate, organic phosphates, e.g., trioctyl phosphate, or like plasticizers, 2-(2-hydroxy-4-tert-butylphenyl)benztriazole or like ultraviolet absorber, and hindered phenols or like antioxidant. For enhancing adhesion between the support and hydrophilic polymer-containing layer, it is preferred to apply a subbing layer to the support and subject the surface of the support to a pretreatment by, e.g., corona discharge, irradiation by ultraviolet rays or flame treatment. The support usually is of a thickness of 20 to 300 microns.

In a desired embodiment of the photographic unit in accordance with the present invention, the image receiving layer is located between the transparent support and a photo-reflective layer that permeates the processing composition, thus a dye image formed by the processing is observable through the support, and it is unnecessary to separate the image receiving element from the photosensitive element after diffusion-transfer of the image. Specific examples of film units having such a function are disclosed in U.S. Pat. Nos. 2,983,606, 3,415,644, 3,415,646, 3,594,164 and 3,594,165. The entire disclosures of the United States patents set forth in this paragraph are hereby incorporated by reference.

In a film unit of the non-separating type, silver halide emulsions associated with a dye image forming material are coated on an opaque support and are exposed from the emulsion side. After exposure, a processing composition is spread in a uniform layer between the surface of the composite emulsion layer and the surface of the image receiving layer on the support. The processing composition contains a photoreflective substance and, therefore, a dye image formed in the image receiving layer by diffusion-transfer of diffusible dyes through the processing composition layer is observed through the transparent support of the image receiving element. In the case of film units of this type, it is necessary to obtain the right image reversed left side right to employ a camera having a special optical system for reversing the image by means of, e.g., a mirror.

In case of film units of the separating type, silver halide emulsions associated with a dye image forming material are coated on a transparent support and are exposed from the support side. After exposure, the processing composition is spread in a layer between the surface of the silver halide emulsion layer and an image receiving layer and a dye image diffused through the processing layer and fixed in the image receiving layer is observed through a transparent support of the dye image receiving layer against the background formed of the photoreflective layer previously provided between the silver halide layer and the image receiving layer or formed of a photoreflective substance contained in the processing composition and spread, during development, in a layer therebetween.

In the case of other film units of the non-separating type, a film unit comprising a transparent support, image receiving layer, a photoreflective layer, a photoshielding layer containing a photoabsorbent substance and one or more silver halide emulsion layers associated with dye image forming materials, arranged in this order, is exposed from the emulsion side and the processing composition is then spread over the surface of the emulsion side. A dye image diffused through the photoreflective and photoshielding layers and fixed in the image receiving layer is observed through the transparent support. Among the film units of this type especially preferred are those having a transparent cover sheet over the emulsion layer. In this case, the film unit is exposed through the cover sheet and the processing composition is spread between the cover sheet and the surface of the emulsion layer.

The present invention will be illustrated in more detail by the following examples with reference to the accompanying drawing.

PREPARATION OF PHOTOSENSITIVE ELEMENTS

EXAMPLE 12

Photosensitive element No. 1 was prepared by applying in order the following layers 11 to 19 to a triacetylcellulose support 10.

(1) Cyan dye developer layer 11 in a mixture of 25 ml of N,N-diethyl-laurylamide, 25 ml of 2-methylcyclohexanone and 1 g of sorbitan monolaurate there was dissolved at 70° C. 15 g of 1,4-bis-(alpha-methyl-beta-hydroquinonyl-amino)-5,8-dihydroxyanthraquinone. The solution was emulsified in 160 ml of a 10 wt. % aqueous solution of gelatin containing 10 ml of a 5 wt. % aqueous solution of sodium dodecylbenzene-sulfonate. The emulsion was diluted by water to a total volume of 500 ml and then applied to form a layer having a dry thickness of 5 microns.

(2) Red-sensitive emulsion layer 12 a red-sensitive silver iodobromide (silver bromide content 1 mole %) emulsion containing $5.5\times10^{-2}$ moles of silver and 5.0 g of gelatin per 100 g was applied to form a dry layer of a thickness of 3.5 microns.

(3) Interlayer 13 a 7 wt. % aqueous solution, containing 0.4 wt. % of sodium bicarbonate, of a terpolymer of 2-hydroxyethyl methacrylate 84.3 mole %, methacrylic acid 7.5 mole % and N,N-dimethylaminoethyl methacrylate 8.2 mole %, as prepared in Example 4, was applied at a coverage of 100 mg/m$^2$.

(4) Magenta dye developer layer 14 in a mixed solvent of 20 ml of N-n-butylacetanilide and 25 ml of methylcyclohexanone there was dissolved 10 g of magenta dye developer, 4 g of propoxy-2-[p-(beta-hydroxyquinonylethyl)phenylazo]-1-naphthol, with heating at about 70° C. and applying ultrasonic waves of 29 kHz for about 30 minutes. The solution was emulsified in 120 ml of a 10 wt. % aqueous solution of gelatin containing 8 ml of a 5 wt. % aqueous sodium n-dodecylbenzenesulfonate. The emulsion was diluted with water to 400 ml and applied to form a 3.5 microns thick dry coating layer.

(5) Green-sensitive emulsion layer 15 a green-sensitive silver iodobromide (silver iodide content of 2 mole %) emulsion containing $4.7\times10^{-2}$ mole of silver and 6.2 g of gelatin per 100 g was applied to form a 1.8 microns thick dried coating layer.

(6) Interlayer 16 a 5 wt. % aqueous gelatin solution containing 1.5 ml of a 5 wt. % aqueous sodium n-dodecylbenzenesulfonate was applied to form an 1.0 micron thick dried layer.

(7) Yellow dye developer layer 17 in a mixed solvent of 10 mol of N-n-butylacetanilide and 25 ml of cyclohexanone there was dissolved 10 g of a yellow dye developer 1-phenyl-3-N-n-hexylcarboxyamide-4-[p-2',5'-(dihydroxyphenethyl)-phenylazo]-5-pyrazolone, with heating and applying ultrasonic vibrations of 29 kHz for about 30 minutes. The solution was emulsified in 100 ml of a 10 wt. % aqueous gelatin containing 80 ml of a 5 wt. % aqueous sodium n-dodecylbenzenesulfonate. To the emulsion there was added 5 ml of a 2 wt. % aqueous 2-hydroxy-4,6-dichloro-s-triazine and then water to a total volume of 300 ml and the emulsion was then applied to form a 1.5 micron thick dried layer.

(8) Blue-sensitive emulsion layer 18 A blue-sensitive silver iodobromide (silver iodide content 7 mole %) emulsion containing $3.5\times10^{-2}$ mole of silver and 6.5 g of gelatin per 100 g was applied to form an 1.5 micron thick dried layer.

(9) Overcoat layer 19 To 100 ml of a 4 wt. % aqueous gelatin containing 2 ml of a 5 25. % aqueous sodium n-dodecylbenzenesulfonate and 5 ml of a 2 wt. % aqueous mucochloric acid there was added 50 g of an emulsion prepared by emulsifying a solution of 8 g of 4√-methylphenylhydroquinone in a mixed solvent of 10 ml of tri-o-cresyl phosphate and 20 ml of ethyl acetate into 50 ml of a 10 wt. % aqueous gelatin by means of a colloid mill, and the resulting mixture was applied to form a 1 micron thick dried coating.

EXAMPLE 13

Photosensitive element No. 2 (control) was prepared for comparison in the same procedure with Example 12 except that the interlayer 13 was formed by applying a 5 wt. % aqueous gelatin containing 1.5 ml. per 100 ml, of a 5 wt. % aqueous sodium n-dodecylbenzenesulfonate to form a 1.5 micron thick dried layer.

EXAMPLES 14 to 20

The same procedure as in Example 12 was repeated except that there were used for interlayers 13 and 16 the polymers indicated in the following Table 2 and the coating was at coverages indicated in Table 2. In Table 2, blanks mean that the polymer used and coverage in interlayer 13, interlayer 19 and/or overcoat layer 19 were the same as with those of photosensitive element No. 2 in Example 13. Thus, there were prepared photosensitive elements 3 to 9.

EXAMPLE 21

The procedures of Example 12 was repeated except that there were used polymers and coverages, as indicated in Table 2, to form photosensitive element 10. The overcoat layer 19 was formed of a 1:1 by weight mixture of a compound of Example 4 and gelatin from solution in a 0.2 % aqueous sodium carbonate solution.

EXAMPLE 22

The procedure of Example 12 was repeated except that there were used polymers and coverages, as indicated in Table 2 to form photosensitive element 11 and that the polymeric layer of the same composition and coverage as the interlayer 13 of photosensitive element 1 was provided between a yellow dye developer layer 17 and the blue-sensitive emulsion layer 18.

TABLE 2

| Photo-sensitive Element No. | Interlayer 13 | | Interlayer 16 | | Overcoat Layer 19 | |
|---|---|---|---|---|---|---|
| | Polymer | Coverage (g/m$^2$) | Polymer | Coverage (g/m$^2$) | Polymer | Coverage (g/m$^2$) |
| 1 | Ex. 4 | 0.1 | | | | |
| 2 | Gelatin | | | | | |
| 3 | Ex. 8 | 1.0 | | | Ex. 4 | 3.0 |
| 4 | | | Ex. 5 | 0.5 | | |
| 5 | | | Ex. 10 | 2.0 | Ex. 4 | 1.0 |
| 6 | Ex. 1 | 0.3 | Ex. 6 | 1.0 | | |
| 7 | Ex. 5 | 5.0 | Ex. 4 | 2.0 | Ex. 7 | 1.0 |
| 8 | Ex. 11 | 2.0 | Ex. 4 | 2.0 | Ex. 9 | 2.0 |
| 9 | Ex. 4 | 1.0 | Ex. 4 | 0.5 | Ex. 4 | 1.0 |
| 10 | Ex. 4 | 1.0 | Ex. 2 | 2.0 | Ex. 4<br>Gelatin | 2.0 |
| 11 | Ex. 3 | 3.0 | Ex. 5 | 2.0 | Ex. 1 | 2.0 |

PREPARATION OF IMAGE RECEIVING ELEMENT

EXAMPLE 23

An image receiving element was prepared by applying to a 250 microns thick support 20 consisting of paper of a weight of 130 g/m$^2$ laminated with polyethylene, in order the following layers:

(1) Neutralizing acid layer 21

A 20 wt. % ethyl acetate solution of a monobutyl ester of a 1:1 by weight copolymer of maleic anhydride and vinyl methyl ether having an average molecular weight of 100,000 was applied to form a 20 microns thick dried coating film.

(2) Neutralizing Rate Controlling Layer (Spacer Layer) 22

A solution of 20 g of poly(2-hydroxyethyl methacrylate) of an average molecular weight of about 350,000 in a mixture of 60 ml of acetone and 20 ml of water was applied voer the neutralizing acid layer to form an 8 microns thick coating film.

(3) Image Receiving Layer 23

In 150 ml of water containing 2 g of glacial acetic acid there were dissolved 6 g of polyvinyl alcohol having a degree of saponification of 98% and a polymerization degree of 1,800 and 3 g of poly-4-vinylpyridine having an average molecular weight of about 70,000 - 80,000, and the solution was applied over the spacer layer 22 to form a 7 microns thick dried film.

PREPARATION OF ALKALINE PROCESSING COMPOSITION

EXAMPLE 24

An alkaline processing composition was prepared by mixing the following ingredients:

| | |
|---|---|
| Water | 100.0 ml |
| Potassium hydroxide | 11.2 g |
| Hydroxyethylcellulose (Natrosol 250 HR, by Hercules inc., USA) | 3.4 g |
| Benzotriazole | 3.5 g |
| N-Benzyl-alpha-picolinium bromide | 2.0 g |
| Zinc nitrate | 0.5 g |
| Potassium thiosulfate | 0.5 g |
| Lithium nitrate | 0.5 g |

EVALUATION OF PHOTOSENSITIVE ELEMENTS

EXAMPLE 25

Each of the photosensitive elements 1 to 11, prepared in Exaples 12 to 23, was exposed to a 1 KW tungsten light having a color temperature of 2,854° K. to give an exposure of 20 CMS through a 20 step optical wedge of density differences of 0.20 and then superposed on the image receiving element. The alkaline processing composition was then spread therebetween in a layer of about 180 microns thick, i.e., in an amount of 1.8 ml/100 cm$^2$ of the image receiving layer. After an imbibition period of 60 seconds, the image receiving layer was separated from the remainder of the assembly to observe the color image transferred thereto. The results were as summarized in the following Table 3.

TABLE 3

| Photo-sensitive Element No. | Deposition of Crystals | | | Exudation of Oil | | |
|---|---|---|---|---|---|---|
| | Yellow | Magenta | Cyan | Yellow | Magenta | Cyan |
| 1 | X | Δ | O | X | X | O |
| 2 | X | X | X | X | X | X |
| 3 | O | Δ | O | O | Δ | O |
| 4 | X | O | Δ | X | O | Δ |
| 5 | O | O | O | O | O | Δ |
| 6 | X | O | O | X | O | O |
| 7 | O | O | O | O | O | O |
| 8 | O | O | O | O | O | O |
| 9 | O | O | O | O | O | O |
| 10 | O | O | O | O | O | O |
| 11 | O | O | O | O | O | O |

In the above Table 3, the symbol O means that there was not observed any deposition or exudation, Δ means there was observed little deposition or exudation and X means there was observed a distinct deposition or exudation. The deterioration tests were carried out by exposing the specimens under conditions of 50° C. 80% R. H., for 7 days.

There were observed improvements in hue, chroma and color separation in those cases where there were used in the interlayer and/or the overcoat layer the polymers of the present invention as compared with the cases where they were not used.

It will be evident from the results summarized in the above Table 3 that the storage stability of the green or unexposed photosensitive element is improved, i.e., recrystallization of the dye developers and exudation of the emulsified oil during storage are minimized, by utilizing the polymer in accordance with the present invention in the interlayer and/or overcoat layer. In addition, it was observed that an improvement in color reproduction of a high density was obtained by utilization of the polymer in accordance with the present invention in the interlayer and/or overcoat layer.

What is claimed is:

1. In a color diffusion transfer photographic product comprising a support carrying at least two dye image-forming units, each comprising a selectively sensitized silver halide emulsion layer associated therewith a dye image forming material capable of forming a diffusible dye contained in either said silver halide emulsion layer or a contiguous layer, an interlayer between said two dye image-forming units and an overcoat layer on the dye image-forming unit furthest from said support, the improvement in which at least one selected from the group consisting of said interlayer and said overcoat layer comprises a polymer of a monoacrylate or monomethacrylate of an aliphatic polyhydric alcohol.

2. A color-diffusion transfer photographic product according to claim 1 comprising a support, at least three dye image forming units carried on said support, each of said dye image-forming units comprising a selectively sensitized silver halide emulsion layer associated with a dye image-forming material contained in said silver halide emulsion layer or a contiguous layer, an interlayer between at least two of said dye image-forming units and a protective overcoat layer on the dye image forming unit furthest from said support, in which at least one of said interlayer and overcoat layer comprises a polymer formed of a monoacrylate or monomethacrylate of an aliphatic polyhydric alcohol.

3. A photographic product according to claim 1, wherein the polymer contains in polymerized form at least 50 mole % a monomethacrylate or monoacrylate of an aliphatic polyhydric alcohol containing 2 to 8 carbon atoms and 2 to 4 hydroxyl groups.

4. A photographic product according to claim 3, wherein the polyhydric alcohol is an alkanepolyol, an alkaneether-alkane polyol or an alkane poly(oxyalkane) polyol.

5. A photographic product according to claim 3, wherein the polymer contains in polymerized form at least 50 mole % at least one acrylate or methacrylate selected from the group consisting of hydroxy-(lower alkyl) acrylates, hydroxy-(lower alkyl) methacrylate, hydroxy(lower-alkoxy-(lower alkyl) acrylates and hydroxy-(lower alkoxy)-(lower alkyl) methacrylates.

6. A photographic product according to claim 5, wherein the lower alkyl and lower alkoxy groups have 2 to 3 carbon atoms.

7. A photographic product according to claim 3, wherein the polymer is a homopolymer of a monoacrylate or monomethacrylate of an aliphatic polyhydric alcohol containing 2 to 8 carbon atoms and 2 to 4 hydroxyl group.

8. A photographic product according to claim 3, wherein the polymer is a copolymer of a monoacrylate or monomethacrylate of an aliphatic polyhydric alcohol containing 2 to 8 carbon atoms and 2 to 4 hydroxyl groups with at least one other ethylenically unsaturated monomeric compound.

9. A photographic product according to claim 3 wherein the polymer is a graft copolymer of a monoacrylate or monomethacrylate of an aliphatic polyhydric alcohol containing 2 to 8 carbon atoms and 2 to 4 hydroxyl groups to a polymer.

10. A photographic product according to claim 3 wherein the polymer has a molecular weight of at least 10,000.

11. A photographic product according to claim 10, wherein the polymer has a molecular weight of 50,000 to 700,000.

12. A photographic product according to claim 1, comprising (a) a support carrying thereon, in order, (b) a dye image-forming material layer, (c) a selectively sensitized silver halide emulsion layer, (d) an interlayer, (e) a dye image-forming material layer, (f) a selectively sensitized silver halide emulsion layer, (g) an interlayer, (h) a dye image-forming material layer, (i) a selectively sensitized silver halide emulsion layer and (j) a protective overcoat layer, in which at least one of said interlayers and protective overcoat layers comprises a polymer of a monoacrylate or monomethacrylate of an aliphatic polyhydric alcohol.

13. A photographic product according to claim 12, wherein at least one of the interlayers comprises a polymer containing in polymerized form at least 50 mole % of a monoacrylate or monomethacrylate of a saturated aliphatic polyhydric alcohol containing 2 to 8 carbon atoms and 2 to 4 hydroxyl groups, said alcohol consisting of C, H and O, the oxygen being present either as said hydroxyl groups or in said hydroxyl groups and as ether oxygen.

14. A photographic product according to claim 12, wherein the protective overcoat layer comprises a polymer containing in polymerized form at least 50 mole % of a monoacrylate or monomethacrylate of an aliphatic polyhydric alcohol containing 2 to 8 carbon atoms and 2 to 4 hydroxyl groups.

15. A photograhic product according to claim 12 wherein the polymer contains in polymerized form at least 50 mole % of at least one acrylate or methacrylate selected from the group consisting of hydroxy-(lower alkyl) acrylates, hydroxy-(lower alkyl) methacrylate, hydroxy-(lower alkoxy)-(lower alkyl) acrylates and hydroxy-(lower alkoxy)-(lower alkyl) methacrylates.

16. A photographic product according to claim 15 wherein the polymer contains in polymerized form at least 50 mole % of a monoacrylate or monomethacrylate of an alkylene glycol containing 2 to 3 carbon atoms.

17. A photographic product according to claim 16, wherein the polymer is a homopolymer of a monoacrylate or monomethacrylate of an alkylene glycol containing 2 to 3 carbon atoms.

18. A photographic product according to claim 16 wherein the polymer is a copolymer of a monoacrylate or monomethacrylate of an alkylene glycol containing 2 to 3 carbon atoms with at least one other $\alpha,\beta$-ethylenically unsaturated monomeric compound.

19. A photographic product according to claim 16, wherein the polymer is a graft copolymer of a monoacrylate or monomethacrylate of an alkylene glycol containing 2 to 3 carbon atoms with gelatin.

20. A color diffusion-transfer photographic product according to claim 1 comprising (a) a support carrying thereon, in order (b) a cyan dye developer layer, (c) a red-sensitive emulsion layer (d) an interlayer, (e) a magenta dye developer layer, (f) a green-sensitive emulsion layer, (g) an interlayer, (h) a yellow dye developer layer, (i) a blue-sensitive emulsion layer and (j) a protective overcoat layer, in which at least one of said interlayers and protective overcoat layer comprises a polymer containing in polymerized form at least 50 mole % of a monoacrylate or monomethacrylate of an aliphatic polyhydric alcohol containing 2 to 8 carbon atoms and 2 to 4 hydroxyl groups.

21. A photographic product, according to claim 20, wherein the polymer contains in polymerized form at least 50 mole % of at least one acrylate or methacrylate selected from the group consisting of hydroxy-(lower alkyl) acrylates, hydroxy-(lower alkyl) methacrylates, hydroxy-(lower alkoxy)-(lower alkyl) acrylates and hydroxy-(lower alkoxy)-(lower alkyl) methacrylates.

22. A photographic product according to claim 1, wherein the support is opaque.

23. A photographic product according to claim 1 in which the support is transparent.

24. A photographic product according to claim 23, wherein said product further contains an image receiving layer, a photoreflective layer and a photoabsorptive substance-containing photo-shielding layer between said support and the dye image-forming unit nearest to said support, in said order from the support.

25. A photographic product according to claim 24, wherein said product further contains a neutralizing acidic layer between said support and said image receiving layer.

26. A photographic product according to claim 25 wherein said product further contains a neutralizing rate-controlling layer between said neutralizing acidic layer and said image receiving layer.

27. A photographic product according to claim 26, wherein said neutralizing acidic layer has a thickness of 2 to 20 microns.

28. A photographic product according to claim 1, wherein the thickness of each of said overcoat layer and said interlayer is about 0.01 to about 30 microns.

29. A photographic product according to claim 28, wherein said thickness is about 0.1 to about 10 micron's for each of said overcoat layer and said interlayer.

30. A photographic product according to claim 29, wherein said thickness is about 0.5 to about 5 microns for each of said overcoat layer and said interlayer.

31. A photographic product according to claim 1, wherein said dye image-forming material is a dye developer.

32. A photographic product according to claim 1, wherein said dye image-forming material is a non-diffusible reactive compound capable of coupling with an oxidized developing agent to form a diffusible dye.

33. A photographic product according to claim 32, wherein said compound is represented by the following general formula (1) or (2):

(1) (Cp-1)-L-(Fr)

(2) (Cp-2)-L-(Bl)

where, in the above formulae, Cp-1 represents a coupling-susceptible moiety substituted in its coupling site by a (Fr)-L- residue and in at least one of its non-coupling sites by a residue containing a hydrophobic group of at least 8 carbon atoms for rendering the coupler molecule non-diffusible, Cp-2 represents a coupling-susceptible moiety substituted in its coupling site by a (Bl)-L- residue, and (Fr)-L- and (Bl)-L- represent such groups which are to be liberated by the action of oxidized developing agent, L is selected from the group consisting of an azo group, an azoxy group, a divalent mercury group, an oxy group, a thio group, a dithio group, a triazolyl group, a diacylamino group, an acylsulfonamino group, an acyloxy group, a sulfonyloxy group and an alkylidene group, Fr represents a chromophoric system having absorption bands in the visible region of wavelength and containing at least one water-solubilizing group, and Bl represents a moiety containing a hydrophobic group of at least 8 carbon atoms for rendering the coupler molecule non-diffusible.

34. A photographic product according to claim 1, in which said dye image-forming material is a reducing agent which is oxidizable with an oxidized developing agent to form a diffusible dye.

35. A photographic product according to claim 1, in which said dye image-forming material is dissolved in a substantially water-insoluble solvent having a boiling point under normal pressure of at least 200° C.

36. A photographic product according to claim 35, in which both of said interlayer and said overcoat layer comprise said polymer.

37. A photographic product according to claim 35, in which at least one of said interlayer and overcoat layer consists essentially of said polymer.

* * * * *